US010571102B1

(12) United States Patent
Bao

(10) Patent No.: US 10,571,102 B1
(45) Date of Patent: Feb. 25, 2020

(54) WORK LIGHT WITH LIGHT SOURCE ASSEMBLY WITH SWING ARM COUPLED TO LIGHT CASING USING A JOINT ASSEMBLY

(71) Applicant: YUYAO YUCHANG ELECTRICAL APPLIANCE CO., LTD., Yuyao, Zhejiang (CN)

(72) Inventor: Yong Bao, Yuyao (CN)

(73) Assignee: YUYAO YUCHANG ELECTRICAL APPLIANCE CO., LTD., Yuyao, Zhejiang (CN)

( * ) Notice: Subject to any disclaimer, the term of this patent is extended or adjusted under 35 U.S.C. 154(b) by 0 days.

(21) Appl. No.: 16/379,762

(22) Filed: Apr. 9, 2019

(51) Int. Cl.

| | |
|---|---|
| ***F21V 21/30*** | (2006.01) |
| ***F21L 4/00*** | (2006.01) |
| ***F21V 23/00*** | (2015.01) |
| *F21W 131/10* | (2006.01) |

(52) U.S. Cl.
CPC ..... *F21V 21/30* (2013.01); *F21L 4/00* (2013.01); *F21V 23/002* (2013.01); *F21W 2131/1005* (2013.01)

(58) Field of Classification Search
CPC . F21W 2131/1005; F21V 21/26; F21V 21/30; F21L 4/04; F21L 4/00
See application file for complete search history.

(56) References Cited

U.S. PATENT DOCUMENTS 9,316,384 B2 * 4/2016 Mumma ..... F21L 14/00

* cited by examiner

*Primary Examiner* — Robert J May
(74) *Attorney, Agent, or Firm* — Raymond Y. Chan; David and Raymond Patent Firm

(57) ABSTRACT

A work light includes a light source assembly, a light casing, and a joint assembly. The light source assembly includes a light housing, a light source housed in the light housing, and a swing arm rearwardly extended from the light housing, wherein the swing arm has a rotatable slot formed thereat. The light casing includes a base casing and a top casing coupled thereon to cover a top opening of the rotatable slot. The joint assembly includes a rotatable axle upwardly and rotatably extended from the base casing through a bottom opening of the rotatable slot, and a coupling shaft downwardly extended from the top casing to the base casing through the rotatable axle, so as to rotatably couple the light source assembly at the light housing.

25 Claims, 8 Drawing Sheets

WORK LIGHT WITH LIGHT SOURCE ASSEMBLY WITH SWING ARM COUPLED TO LIGHT CASING USING A JOINT ASSEMBLY

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to lighting device, and more particularly to a work light, which provides a double shaft structure to ensure a rotatable movement of the light source to selectively adjust the light projecting angle of the work light.

DESCRIPTION OF RELATED ARTS

Work lights, such as workbench lights or automobile repair work lights, are common light devices in the market of illumination. A conventional work light generally comprises a light housing and a light source pivotally coupled at the light housing to adjust a light projecting angle of the light source. However, there are several drawbacks of the conventional work light.

The movement of the light source is limited to adjust the light projecting angle thereof. Accordingly, via the pivotal engagement between the light source and the light housing, the light source can only pivotally moved at either the horizontal direction or vertical direction. It should be appreciated that two different pivot joints can be provided between the light source and the light housing to provide different pivotal movements of the light source. However, the movable parts of the work light will weaken the strength of the joints between the light source and the light housing, such that the light source will be easily broken while adjusting the light projecting angle.

The size of the work light is relatively bulky. In order to stably support the light source, the light housing must be large and heavy enough to hold the light source in position and to allow the movement of the light source. The light housing may also incorporate with a tripod stand to elevate the position of the light source. Therefore, the size and weight of the light housing will reduce the portability of the work light.

Accordingly, the work light can be eclectically powered either by electrically connecting to a power outlet via a power cable or a rechargeable battery. The portability of the work light will be limited by the power cable, especially by the length of the power cable. In other words, the work light with the power cable is considered as a stationary work light. The work light can be considered as a portable light device when using the rechargeable battery. Both types of work light have the common problem is that the work light does not provide any waterproof ability for prevent electric shock. The power cable cannot provide any water resistance when it is plugged into the power outlet. Likewise, water may enter into the rechargeable battery to damage the rechargeable battery. Importantly, electrical wires must be extended through the light housing to electrically connect the light source to the rechargeable battery. Since the light source is movably coupled at the light housing via the pivot joint, water may enter into the light source and rechargeable battery through the space of the pivot joint and along the electrical wires. The complicated movable structure and electrical configuration will highly increase the manufacturing cost of the work light.

SUMMARY OF THE PRESENT INVENTION

The invention is advantageous in that it provides a work light, which provides a double shaft structure of a joint assembly to ensure a rotatable movement of the light source to selectively adjust the light projecting angle of the work light.

Another advantage of the invention is to a work light, wherein the double shaft structure provides a first shaft means for enabling the rotatable movement of the light head with respect to the light casing and a second shaft means for securing the light head at the light casing.

Another advantage of the invention is to a work light, wherein the joint assembly further provides an enclosing space for a communication cable sealedly extending from a control panel to the light head.

Another advantage of the invention is to a work light, wherein the light projecting angle of the light head can be selectively adjusted at a longitudinal direction via a rotatable movement of the light head and at a transverse direction via a rotatable movement of the light casing.

Another advantage of the invention is to a work light, which comprises a battery assembly electrically connected to the light head to enhance the portability of the work light.

Another advantage of the invention is to a work light, wherein the battery assembly provides a water protection feature to prevent any water damage to the battery.

Another advantage of the invention is to a work light, wherein all components of the work light are modularized to simply the manufacturing process of the work light and to reduce the manufacturing cost of the work light.

Another advantage of the invention is to a work light, wherein no expensive or complicated structure is required to employ in the present invention in order to achieve the above mentioned objects. Therefore, the present invention successfully provides an economic and efficient solution for providing an effective light device with high degree of light angle adjustment while being cost effective.

Additional advantages and features of the invention will become apparent from the description which follows, and may be realized by means of the instrumentalities and combinations particular point out in the appended claims.

According to the present invention, the foregoing and other objects and advantages are attained by a work light, which comprises a light source assembly, a light casing, and a joint assembly.

The light source assembly comprises a light housing, a light source housed in the light housing, and a swing arm rearwardly extended from the light housing, wherein the swing arm has a rotatable slot formed thereat.

The light casing comprises a base casing and a top casing coupled thereon to cover a top opening of the rotatable slot.

The joint assembly comprises a rotatable axle upwardly and rotatably extended from the base casing through a bottom opening of the rotatable slot, and a coupling shaft downwardly extended from the top casing to the base casing through the rotatable axle, so as to rotatably couple the light source assembly at the light housing.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
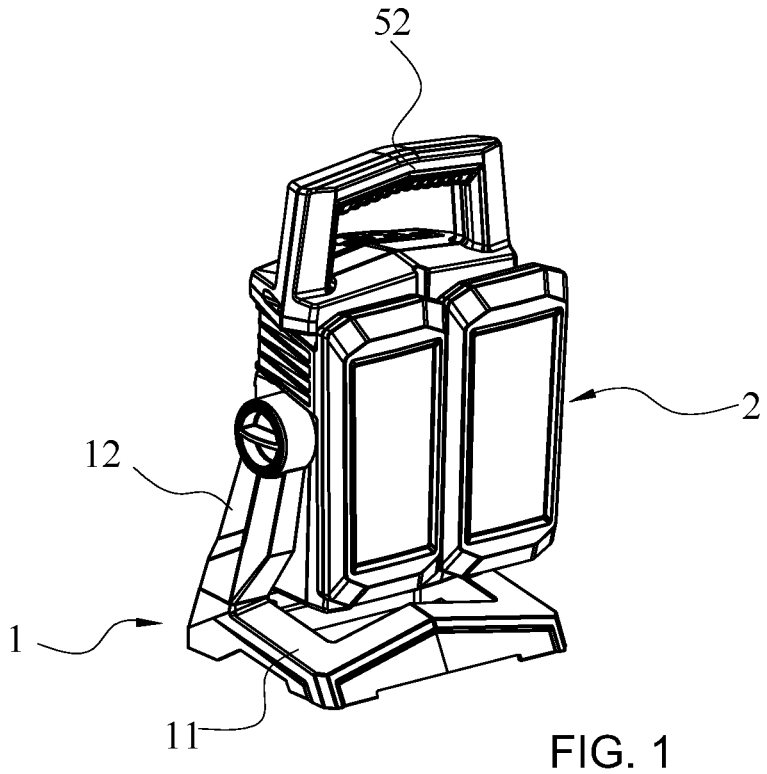
FIG. 1 is a front perspective view of a work light according to a preferred embodiment of the present invention.
Figure 2:
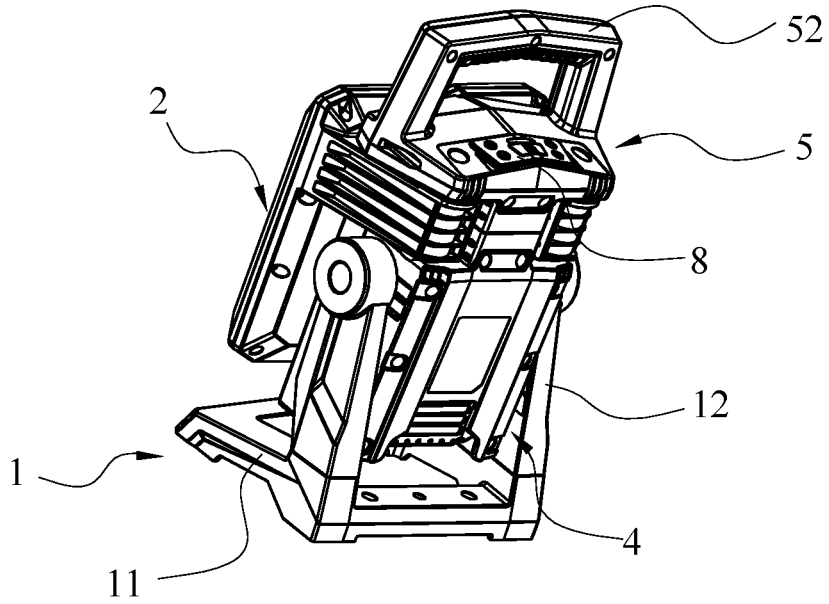
FIG. 2 is a rear perspective view of the work light according to the above preferred embodiment of the present invention.
Figure 3:
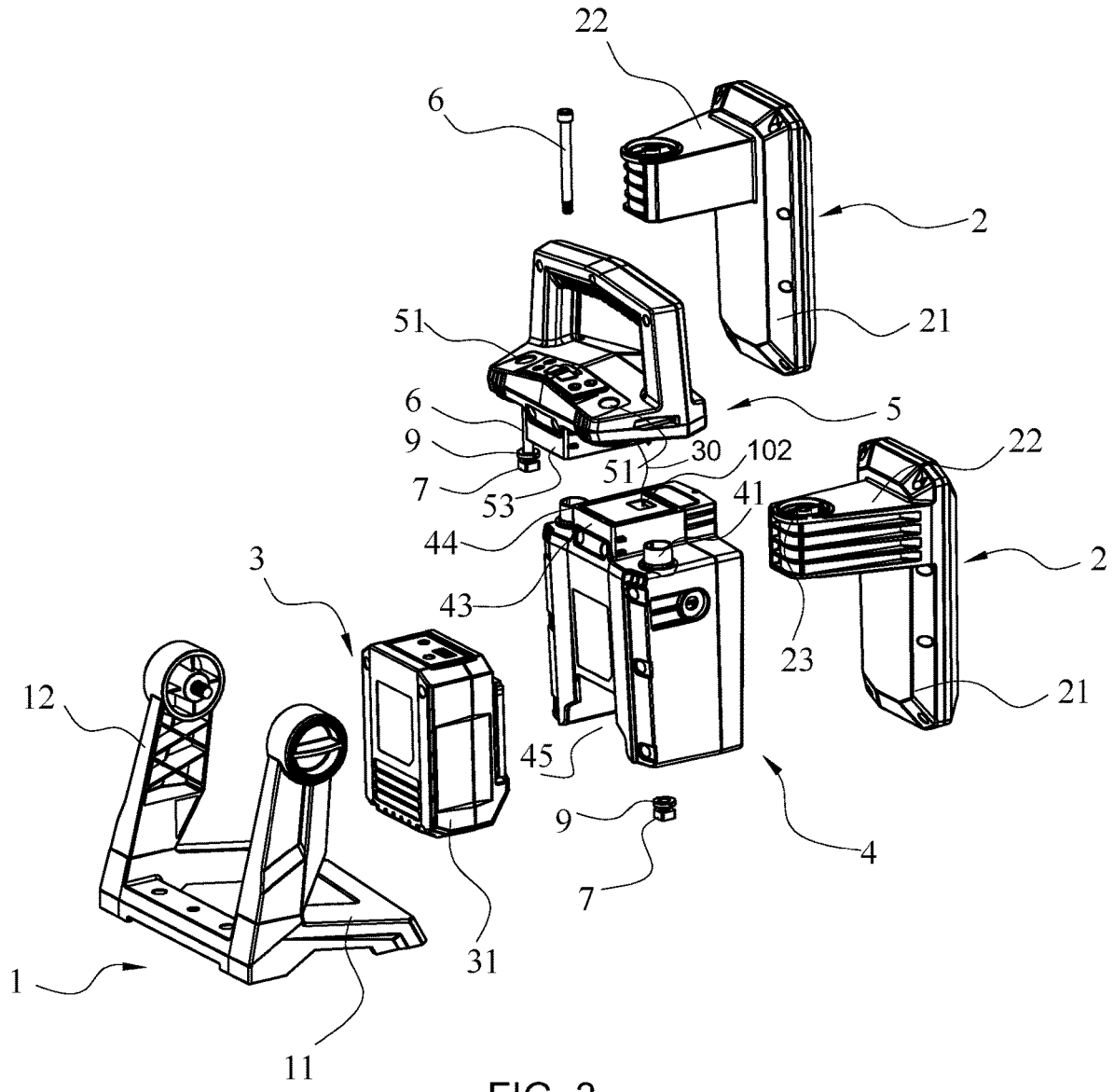
FIG. 3 is an exploded perspective view of the work light according to the above preferred embodiment of the present invention.

Referring to FIGS. 1 to 3, a work light according to a preferred embodiment of the present invention is illustrated, wherein the work light comprises a light source assembly, a light casing 1, and a joint assembly for rotatably coupling the light assembly at the light casing 1.

The light source assembly comprises one or more light heads 2 rotatably coupled at the light casing 1. In one embodiment two light heads 2 are provided and are independently coupled at the light casing 1, such that each of the light heads 2 is adapted to selectively rotate with respect to the light casing 1 to adjust a light projecting angle of the light head 2.

Figure 5:
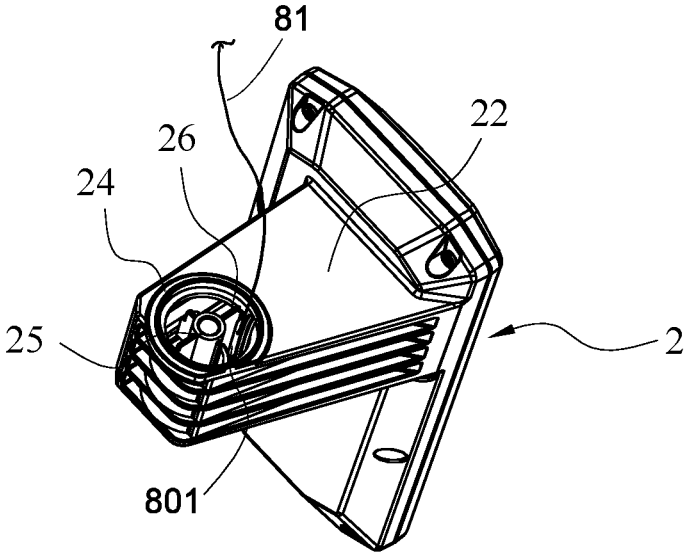
FIG. 5 is a top perspective view of a light head of the work light according to the above preferred embodiment of the present invention.
Figure 6:
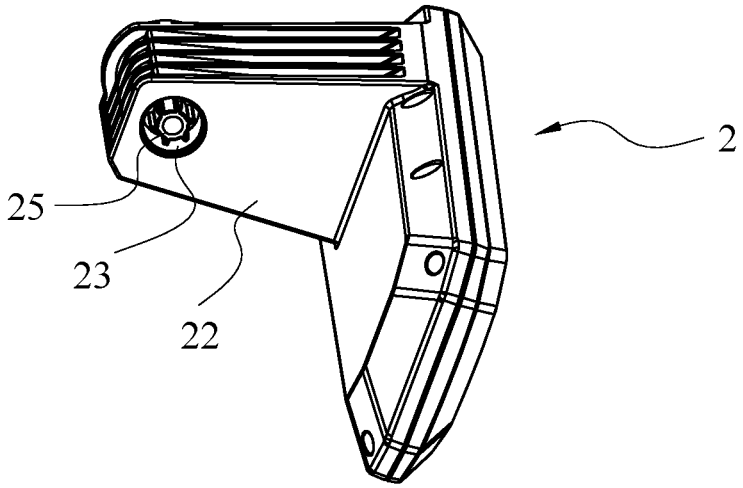
FIG. 6 is a bottom perspective view of a light head of the work light according to the above preferred embodiment of the present invention.

Each of the light heads 2 comprises a light housing 21, a light source 20 housed in the light housing 21, and a swing arm 22 rearwardly extended from the light housing 21. Accordingly, the light housing 21 has a front transparent lens, wherein the light generated from the light source 20 is able to penetrate through the front transparent lens of the light housing 21. Preferably, the light source 20 comprises a circuit board and a plurality of LEDs electrically connected on the circuit board. As shown in FIGS. 3, 5 and 6, the swing arm 22 is rearwardly extended from a top portion of the light housing 21, wherein the swing arm 22 has a rotatable slot 23 formed thereat.

The light casing 1 comprises a base casing 4 and a top casing 5 coupled thereon, wherein a top opening of the rotatable slot 23 is covered by a bottom side of the top casing 5 while a bottom opening of the rotatable slot 23 is covered by a top side of the base casing 4.

The joint assembly provides a double shaft structure for rotatably coupling the light assembly at the light casing 1. Accordingly, the joint assembly comprises a rotatable axle 41 upwardly and rotatably extended from the base casing 4 through the bottom opening of the rotatable slot 23, and a coupling shaft 6 downwardly extended from the top casing 5 to the base casing 4 through the rotatable axle 41, so as to rotatably couple the light source assembly at the light housing 1.

Figure 8:
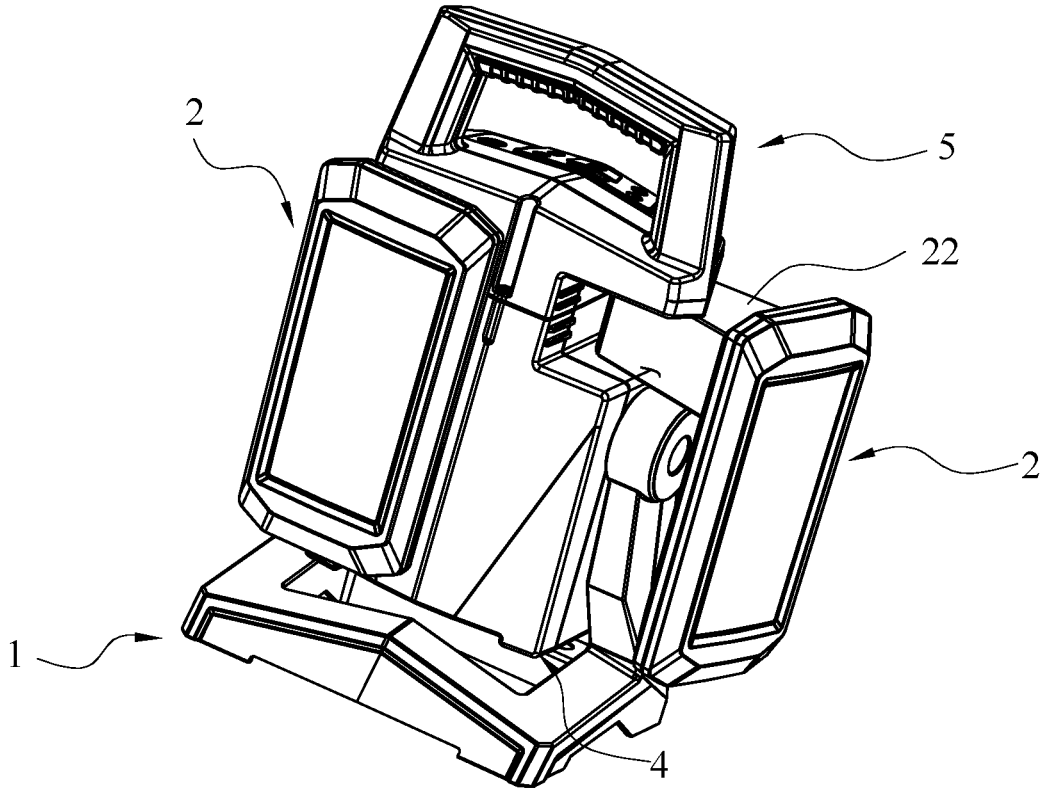
FIG. 8 illustrates the rotatable movement of the light head of the work light according to the above preferred embodiment of the present invention.

As shown in FIG. 3, the base casing 4 comprises a raised protruding member 43 upwardly extended from the top side of the base casing 4. Preferably, the raised protruding member 43 is upwardly extended from a mid-portion of the top side of the base casing 4, such that two side portions of the top side of the base casing 4 are defined. In other words, the raised protruding member 43 is located between the two side portions of the top side of the base casing 4. According to the preferred embodiment, two rotatable axles 41 are upwardly extended from the two side portions of the top sides of the base casing 4 respectively, wherein the two rotatable axles 41 are rotatably inserted into the rotatable slots 23 of the light heads 2 respectively from the bottom openings thereof, such that the two light heads 2 are independently rotated at a longitudinal direction to independently adjust the light projecting angles thereof, as shown in FIG. 8. It is worth mentioning that each of the light head 2 can be rotated at least 180 degrees via the corresponding joint assembly.

Figure 7:
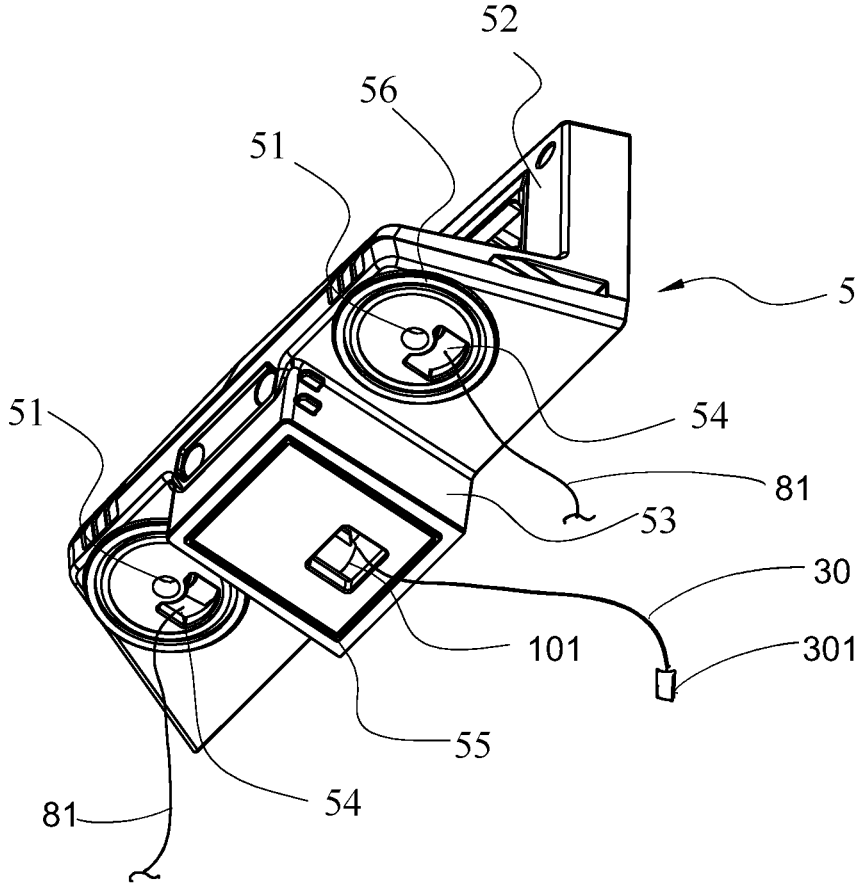
FIG. 7 is a bottom perspective view of a top casing of the work light according to the above preferred embodiment of the present invention.

As shown in FIG. 7, the top casing 5 comprises a handle frame 52 and a downward protruding member 53 downwardly extended from a bottom side of the top casing 5. Correspondingly, the downward protruding member 53 is downwardly extended from a mid-portion of the bottom side of the top casing 5, such that two side portions of the bottom side of the top casing 5 are defined. In other words, the downwardly protruding member 53 is located between the two side portions of the bottom side of the top casing 5. Accordingly, the handle frame 52 has an inverted U-shape formed on the top casing 5, such that the work light can be carried via the handle frame 52.

The light casing further comprises a light stand 11 which comprises two upward extending arms 12 rotatably coupled at two sides of the base casing 4 respectively. Accordingly, the light projecting angles of the light heads 2 can be selectively adjusted at the transverse direction when the base casing 4 is rotatably moved with respect to the light stand 11 via the extending arms 12, so as to selectively adjust the titled positions of the light heads 2, as shown in FIG. 2. It is worth mentioning that the light heads 2 can be rotated at least 180 degrees via the light stand 11.

The top casing 5 further comprises a ceiling cover 56 aligning with and covering the rotatable slot 23 when the top casing 5 is coupled at the base casing 4. Accordingly, two ceiling covers 56 are formed at the two side portions of the bottom side of the top casing 5 respectively to cover the top openings of the rotatable slots 23 at the swing arms 22 respectively.

When the top casing 5 is coupled at the base casing 4, the downward protruding member 53 is aligned with and biased against the raised protruding member 43, such that two side openings are formed at the light casing 1. The two swing arms 22 of the light heads 2 are rotatably received at the side openings of the light casing 1 respectively. In other words, the top openings of the rotatable slots 23 at the swing arms 22 are covered by the two side portions of the bottom side of the top casing 5 while the bottom openings of the rotatable slots 23 at the swing arms 22 are covered by the two side portions of the top side of the base casing 4. Preferably, a total height of the downward protruding member 53 and the raised protruding member 43, i.e. a height of the side opening, matches with a thickness of the swing arm 22, such that when the top casing 5 is coupled on the base casing 4, the swing arm 22 is rotatably coupled between the bottom side of the top casing 5 and the top side of the base casing 4.

In order to enhance the waterproof ability for the work light, a waterproof and dustproof engagement is provided between the raised protruding member 43 and the downward protruding member 53. In one embodiment, the base casing 4 further has an indention groove 44, preferably formed in a ring shape, formed on a top side of the raised protruding member 43 at a peripheral portion thereof. Correspondingly, the top casing 5 further comprises a protrusion rib 55, preferably formed in a ring shape, formed on a bottom side of the downward protruding member 53 at a peripheral portion thereof. When the top casing 5 is coupled at the base casing 4 to bias the downward protruding member 53 against the raised protruding member 43, the protrusion rib 55 is engaged with the indention groove 44 to water-seal and dust-tight a contacting area between the raised protruding member 43 and the downward protruding member 53. It is appreciated that a sealing ring can be formed between the top side of the raised protruding member 43 and the bottom side of the downward protruding member 53 to water-seal and dust-tight the contacting area between the raised protruding member 43 and the downward protruding member 53. Accordingly, the waterproof and dustproof engagement can provide IP 54 rating according to the International Protection IP rating system.

For the waterproof and dustproof engagement, as shown in FIGS. 5 and 7, the top casing 5 further comprises an indention ring 56 formed at the bottom side of the top casing 5 around the ceiling cover 56, and correspondingly the light head 2 further comprises a protrusion ring 24 upwardly extended from the top side of the swing arm 22 around the rotatable slot 23. When the swing arm 22 is coupled underneath the top casing 5 to cover the rotatable slot 23 by the ceiling cover 56, the protrusion ring 24 is engaged with the indention ring 56. The engagement between the protrusion ring 24 and the indention ring 56 will provide the waterproof and dustproof ability between the swing arm 22 and the top casing 5. The engagement between the protrusion ring 24 and the indention ring 56 not only forms a coupling alignment for guiding the connection position between the top casing 5 and the swing arm 22 but also forms a rotatable alignment for guiding the rotatable movement of the swing arm 22 with respect to the top casing 5.

Figure 4:
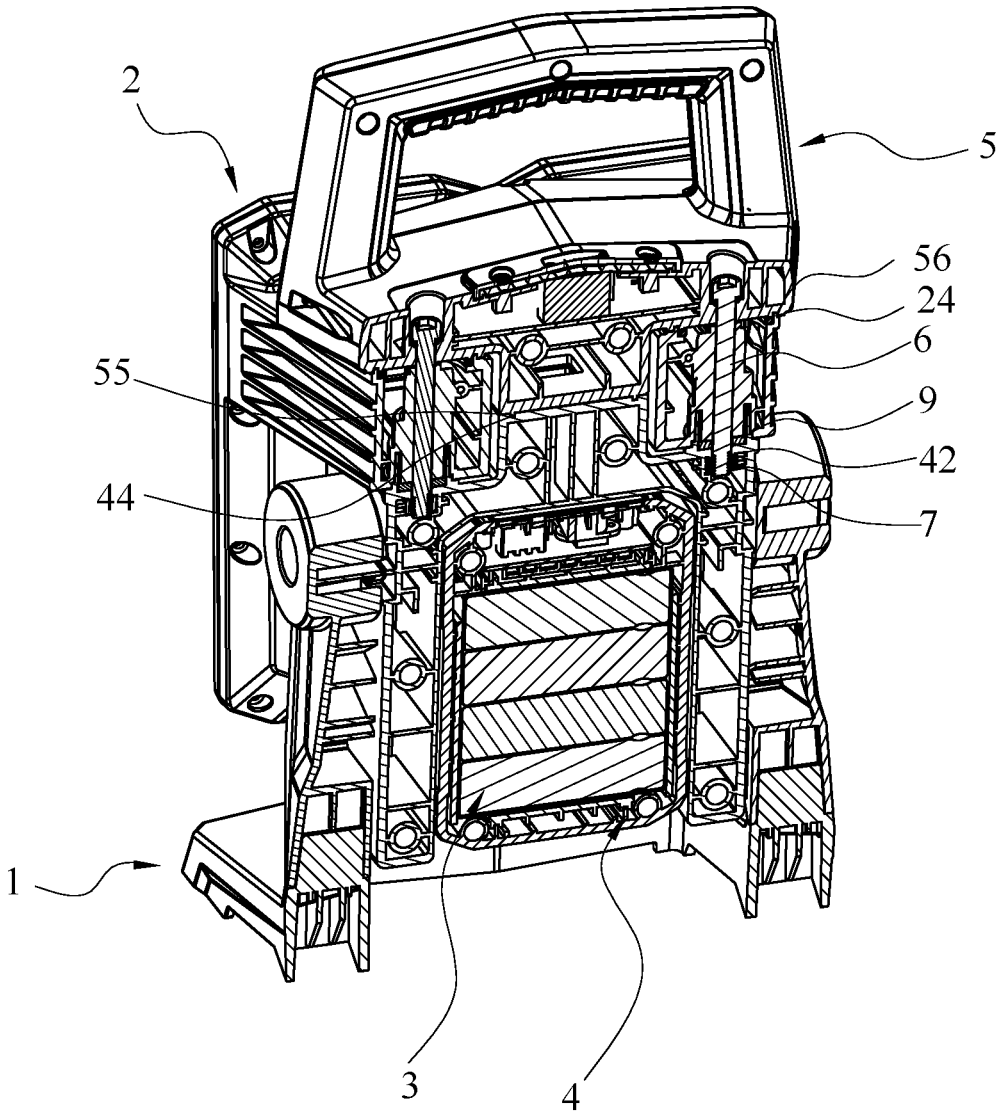
FIG. 4 is a sectional view of the work light according to the above preferred embodiment of the present invention.

As shown in FIGS. 3 and 4, the rotatable axle 41 has a hollow structure upwardly extended from each side portion of the top side of the base casing 4 to rotatably insert into the rotatable slot 23 at the swing arm 22 from the bottom opening of the rotatable slot 23, wherein a diameter size of the rotatable axle 41 is slightly smaller than a diameter size of the rotatable slot 23. Therefore the rotatable axle 41 serves as a first shaft means for rotatably coupling the light head 2 at the light casing 1.

The coupling shaft 6 is made of rigid material, such as metal, to have an elongated solid structure, wherein the coupling shaft 6 is penetrated through the top casing 5 to the base casing 4 to coaxially extend through the rotatable slot 23. Therefore the coupling shaft 6 serves as a second shaft means for rotatably coupling the light head 2 at the light casing 1. As shown in FIGS. 3, 4 and 7, the top casing 5 further has a shaft through hole 51 formed thereat for the coupling shaft 6 extending therethrough. The shaft through hole 51 is formed at a center of the ceiling cover 56, wherein the coupling shaft 6 is extended through the shaft through hole 51 at the ceiling cover 56, is then extended through the rotatable slot 23, and is further extended through the rotatable axle 41. In other words, a length of the coupling shaft 6 must be long enough to extend from the top casing 5 to the base casing 4.

The joint assembly further comprises a shaft locker 7, having an enlarged head end, detachably coupled at a bottom end of the coupling shaft 6 to lock up the top casing 5 at the base casing 4. An anti-wear washer 9 is provided at the bottom opening of the rotatable slot 23 when the coupling shaft 6 is extended through the washer 9. As shown in FIG. 4, the base casing 4 further has a locker cavity 42 alignedly formed underneath the rotatable axle 41, wherein the shaft locker 7, such as a nut, is disposed at the locker cavity 42 to couple at the bottom end of the coupling shaft 6 when the coupling shaft 6 is extended through the rotatable axle 41. In other words, the top casing 5 and the base casing 4 are locked up between the enlarged head end and the bottom end of the shaft locker 7.

According to the preferred embodiment, the joint assembly further comprises a hollow shaft 25 coaxially supported within the rotatable slot 23 to coaxially insert into the rotatable axle 41, wherein the coupling shaft 6 is coaxially extended through the hollow shaft 25 to coaxially extend through the rotatable slot 23. Accordingly, a length of the hollow shaft 25 is not longer than a length of the rotatable slot 23. A diameter size of the hollow shaft 25 is smaller than a diameter size of the rotatable slot 23 and is smaller than a diameter size of the rotatable axle 41. In other words, the rotatable axle 41 is coaxially inserted into the rotatable axle 23 and, at the same time, the hollow shaft 25 is coaxially inserted into the rotatable axle 41. In addition, the diameter size of the hollow shaft 25 is slightly larger than a diameter size of the coupling shaft 6, such that the coupling shaft 6 is extended through the hollow shaft 25. Therefore, the joint assembly provides a multiple layered shaft structure to rigidly support the light head 2 in a rotatably movable manner and to securely connect the top casing 5 on the base casing 4.

In order to suspendedly support the hollow shaft 25 within the rotatable slot 23, the joint assembly further comprises a plurality of radial arms 26 radially and outwardly extended from an outer wall of the hollow shaft 25 to an inner wall of the rotatable slot 23 to coaxially support the hollow shaft 25 within the rotatable slot 23. Accordingly, the radial arms 26 are radially extended from a top portion of the hollow shaft 25 close to the top opening of the rotatable slot 23, such that the rotatable axle 41 is able to coaxially insert into the rotatable slot 23 from the bottom opening thereof without being blocked by the radial arms 26. In other words, the length of the rotatable axle 41 is short enough to insert into the rotatable slot 23 without contacting to the radial arms 26. Furthermore, a suspended portion of the hollow shaft 25, i.e. a portion of the hollow shaft 25 below the radial arms 26, is coaxially inserted into the rotatable axle 41.

According to the preferred embodiment, the work light further comprises a control panel 8 provided at the top casing 5 and electrically connected to the light heads 2 of the light source assembly. The control panel 8 comprises a control circuit for controlling the light heads 2 in an on-and-off manner, and for selectively adjusting light intensity and light effect of the light source 20. The control panel 8 is coupled on a top side of the top casing 5. Accordingly, the control panel 8 is connected to the light head 2 via a communication cable 81. Particularly, the communication cable 81 is extended from the top casing 5 to the base casing 4 through the rotatable slot 23 to electrically connect the control panel 8 to each light head 2 of the light source assembly.

In order to guide the communication cable 81 through the rotatable slot 23 without interfering the hollow shaft 25 and the rotatable axle 41 within the rotatable slot 23, the joint assembly provides a particular cable passage to prevent the damage of the communication cable 81 during the rotatable movement of the light head 2. The communication cable 81 is extended between the outer wall of the hollow shaft 25 and the inner wall of the rotatable slot 23. Particularly, the communication cable 81 is extended through a channel 801 formed between two adjacent radial arms 26 to extend through the rotatable slot 23, as shown in FIG. 5. When the rotatable axle 41 is coaxially inserted into the rotatable slot 22, the hollow shaft 25 is coaxially inserted into the rotatable axle 41. However, the communication cable 81 will not further extend downwardly to the rotatable axle 41 because the communication cable 81 will extend to the channel B to electrically connect to the light source 20 through the swing arm 22.

As shown in FIG. 7, the top case 5 further has a communication slot 54 formed on the ceiling cover 56 for the communication cable 81 extending from the control panel 8 to the rotatable slot 23 through the communication slot 54. Accordingly, the control panel 8 is provided on top of the top casing 5 at a position above the ceiling cover 56. When the top casing 5 is coupled at the swing arm 22 to cover the rotatable slot 23 by the ceiling cover 56, the communication cable 81 is extended from the control panel 8 to the rotatable slot 23 through the communication slot 54. It is worth mentioning that the communication slot 54 is formed at an off-center of the ceiling cover 56 at a position adjacent to the shaft through hole 51. Via the above mentioned waterproof and dustproof engagement, no water or dust can enter into the rotatable slot 23 to prevent any damage of the communication cable 81 by water or dust.

As shown in FIGS. 2 to 4, the work light further comprises a battery assembly 3 coupled at the base casing 4 to electrically connect with the light source assembly. Particularly, the battery assembly 3 is electrically connected to the light heads 2 through the control panel 8. Accordingly, the base casing 4 has a battery compartment 45 formed at a bottom portion of the base casing 4 to receive the battery assembly 3. Preferably, the battery compartment 45 has a bottom opening, such that the battery assembly 3 is upwardly slid into the battery compartment 45 to detachably couple the battery assembly 3 at the base casing 4 to prevent any water entering into the battery assembly 3.

Figure 9:
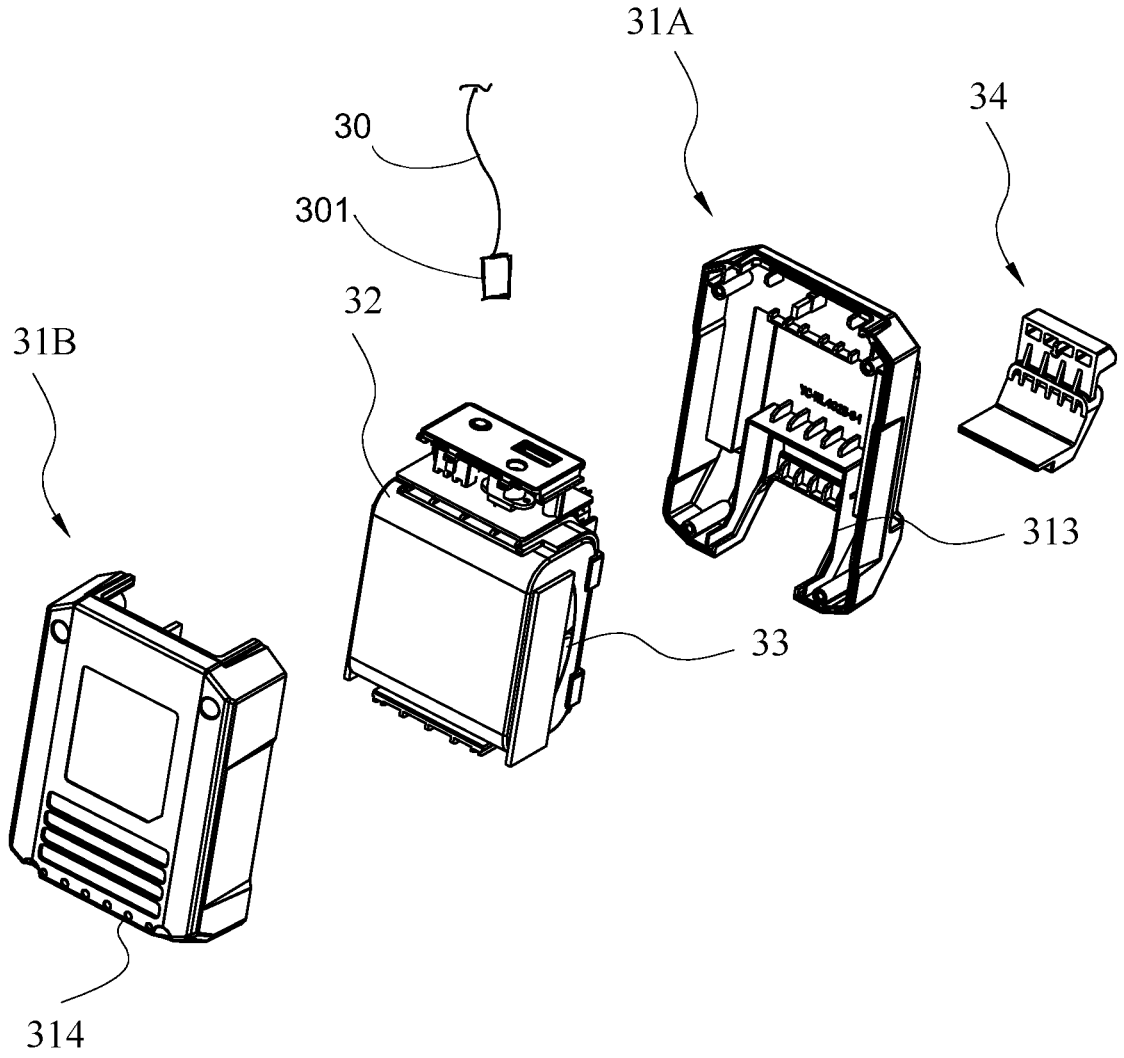
FIG. 9 is rear exploded perspective view of a battery assembly of the work light according to the above preferred embodiment of the present invention.
Figure 10:
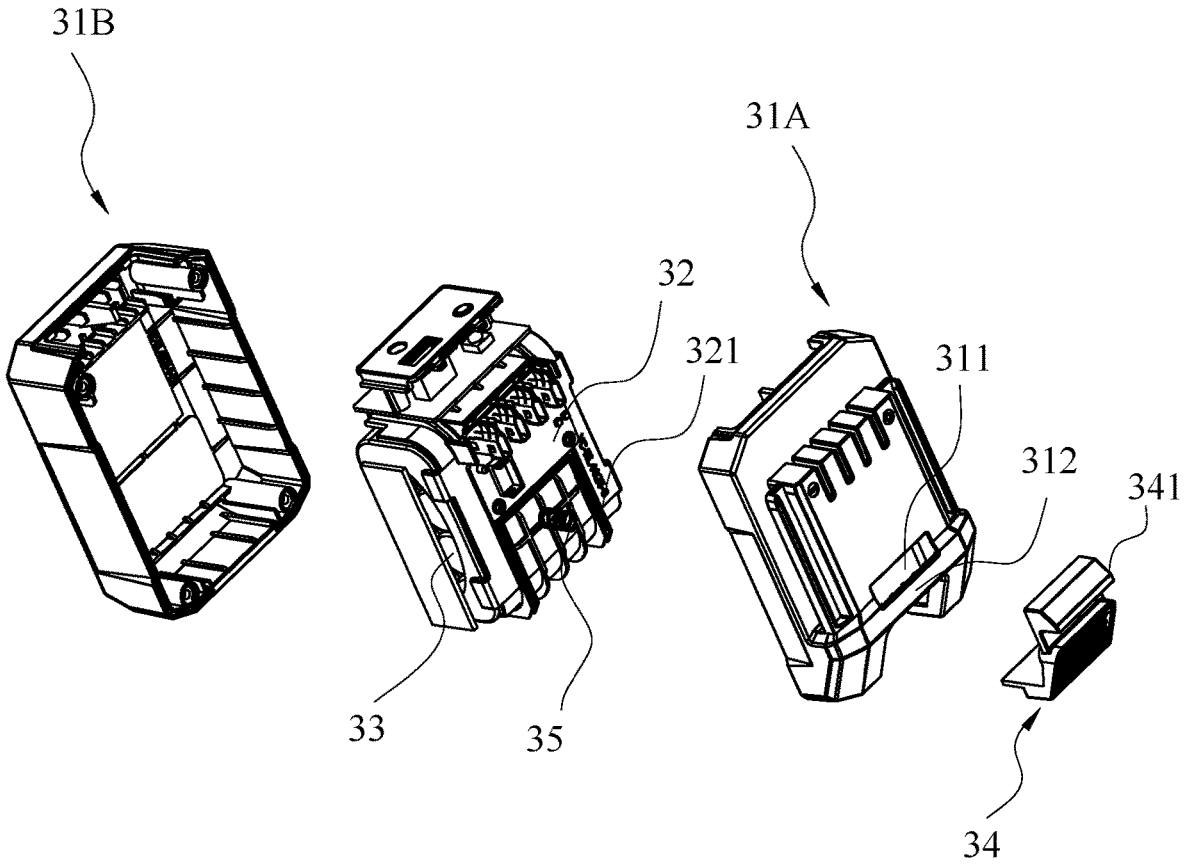
FIG. 10 is front exploded perspective view of the battery assembly of the work light according to the above preferred embodiment of the present invention.

As shown in FIGS. 9 and 10, the battery assembly 3 comprises an outer protective casing 31, and a battery pack 32 received in the outer protective casing 31 for receiving one or more batteries 33 in a battery cavity of the battery pack 32.

The outer protective casing 31 comprises a first casing member 31A and a second casing member 31B, such as a front and rear casing members, coupled with each other to house the battery pack 32 therewithin. Accordingly, the batteries 33 can be rechargeable batteries or replaceable batteries received in the battery cavity of the battery pack 32. For replacing the batteries 33, the first and second casing members 31A, 31B can be detached to remove the battery pack 32 from the outer protective casing 31. After the replacement of the batteries 33, the battery pack 32 can be received back in the outer protective casing 31 between the first and second casing members 31A, 31B by re-coupling the first and second casing members 31A, 31B with each other.

In order to provide a waterproof feature of the battery assembly 3, the battery pack 32 has an engaging groove 321 formed thereon at a position around the battery cavity. Accordingly, the engaging groove 321 has an inverted U-shape formed at a top edge and two side edges of the battery cavity of the battery 32. Correspondingly, the outer protective casing 31 comprises an engaging ridge 313 extended from an inner side of the outer protective casing 31 to engage with the engaging grove 321 to shield the battery cavity of the battery pack 32. Particularly, the engaging ridge 313 is integrally extended from an inner side of the first casing member 31A to engage with the engaging groove 321. In case of water leakage, the engagement between the engaging ridge 313 and the engaging groove 321 will block the water entering into the battery cavity of the battery pack 32 to damage the batteries 33 therein. Accordingly, a sealing ring can also be provided between the outer protective casing 31 and the battery pack 32 to encircle around the battery cavity thereof to enhance the waterproof ability of the battery assembly 3. The outer protective casing 31 has one or more water drainage slots 314 for draining water in case of the water enters into the outer protective casing 31. Accordingly, the water drainage slots 314 are formed at the bottom side of the outer protective casing 31 to drain the water within the outer protective casing 31. In one embodiment, the water drainage slots 314 are formed at the bottom side of the second casing member 31B of the outer protective casing 31.

According to the preferred embodiment, the battery assembly 3 further comprises a locking member 34 movably extended from the battery pack 32 through the outer protective casing 31 to lock up with the base casing 4 at the battery compartment 45 so as to secure the battery assembly 3 at the base casing 4.

The locking member 34 has a locking hook 341 extended forwardly to detachably engage with a locking portion of the base casing 4 within the battery compartment 45. The outer protective casing 31 further has a window 311 formed at the first casing member 31A, wherein the locking hook 341 is extended out of the outer protective casing 31 through the window 311. In other words, a body of the locking member 34 is movably supported between the battery pack 32 and the outer protective casing 31, wherein the locking hook 341 is extended from the body of the locking member 34 through the window 311. The locking member 34 has a coupling slot formed thereat, wherein the outer protective casing 31 further comprises a coupling member 312 to engage with the coupling slot to retain the locking member 34 at the outer protective casing 31 is a movable manner. Accordingly, the coupling member 312 is formed underneath the window 311 at the first casing member 31A, wherein the coupling slot is indentedly formed at the locking member 34 below the locking hook 341. Therefore, the locking member 34 is moved between a locked position and an unlocked position via the engagement between the coupling member 312 and the coupling slot. At the locked position, the locking member 34 is outwardly pushed toward the outer protective casing 31 to protrude the locking hook 341 out of the outer protective casing 31 through the window 311, such that the locking hook 341 is extended outwardly to engage with the base casing 4 to lock up the battery assembly 3 at the battery compartment 45 of the base casing 4. At the unlocked position, the locking member 34 is inwardly pushed toward the battery pack 32, wherein the locking hook 341 is slid in the window 311 of the outer protective casing 31 to disengage the locking hook 341 with the base casing 4, such that the battery assembly 3 is unlocked and is adapted to disengage from the battery compartment 45 of the base casing 4. Then, the battery assembly 3 can be downwardly slid out of the battery compartment 45 of the base casing 4 to detach the battery assembly 3 from the base casing 4.

The battery assembly 3 further comprises a resilient element 35 extended from the battery pack 32 to push the locking member 34 at a position that the locking hook 341 is extended out of the window 311, so as to retain the locking member 34 at the locked position. Accordingly, the resilient element 35 is supported between the battery pack 32 and the outer protective casing 31. In one embodiment, the resilient element 35, which is a compression spring, has one end biasing against the battery pack 32 and an opposed end biasing against the locking member 34 to apply a resilient force to push the locking member 34 toward the outer protective casing 31. In other words, when the locking member 34 is moved at the unlocked position, the resilient element 35 is compressed to restore resilient force thereat. Accordingly, the locking member 35 has a pusher surface formed below the coupling member 312, wherein when the pusher surface is pushed to compress the resilient element 35 and to move the locking member 34 from the locked position to the unlocked position. Once the pushing force at the pusher surface is released, the resilient element 35 will push the locking member 34 back to the locked position from the unlocked position.

The battery assembly 3 is electrically connected to the control panel 8 via a power cable 30, wherein the power cable 30 is extended through the light casing 1. As shown in FIGS. 3 and 7, the light casing 1 further has a first cable slot 101 formed at the top casing 5 and a second cable slot 102 formed at the base casing 4, wherein when the top casing 5 is coupled at the base casing 4, the first cable slot 101 is aligned and communicated with the second cable slot 102, such that the power cable 30 is extended through the first and second cable slots 101, 102 to electrically connect the control panel 8 with the battery assembly 3. In one embodiment, the first cable slot 101 is formed at the bottom side of the downward protruding member 53 of the top casing 5 while the second cable slot 102 is formed at the top side of the raised protruding member 43 of the base casing 4, such that when the downward protruding member 53 is engaged with the raised protruding member 43 to couple the top casing 5 with the base casing 4, the first cable slot 101 is aligned and communicated with the second cable slot 102 to allow the power cable 30 being extended through the first and second cable slots 101, 102. Furthermore, the power cable 30 further has a connector end 301 extended to detachably couple with a terminal of the battery assembly 3.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A work light, comprising:

a light source assembly which comprises a light housing, a light source housed in said light housing, and a swing arm rearwardly extended from said light housing, wherein said swing arm has a rotatable slot formed thereat;

a light casing which comprises a base casing and a top casing coupled thereon to cover a top opening of said rotatable slot; and a joint assembly which comprises a rotatable axle upwardly and rotatably extended from said base casing through a bottom opening of said rotatable slot, and a coupling shaft downwardly extended from said top casing to said base casing through said rotatable axle, so as to rotatably couple said light source assembly at said light housing.

2. The work light, as recited in claim 1, wherein said joint assembly further comprises a hollow shaft coaxially supported within said rotatable slot to coaxially insert into said rotatable axle, wherein said coupling shaft is coaxially extended through said hollow shaft to coaxially extend through said rotatable slot.

3. The work light, as recited in claim 2, wherein said joint assembly further comprises a plurality of radial arms radially and outwardly extended from an outer wall of said hollow shaft to an inner wall of said rotatable slot to coaxially support said hollow shaft within said rotatable slot.

4. The work light, as recited in claim 2, further comprising a control panel provided at said top casing and electrically connected to said light source assembly via a communication cable, wherein said communication cable is extended from said top casing to said base casing through said rotatable slot to electrically connect said control panel to said light source assembly.

5. The work light, as recited in claim 4, wherein said communication cable is extended between an outer wall of said hollow shaft and an inner wall of said rotatable slot.

6. The work light, as recited in claim 5, wherein said joint assembly further comprises a plurality of radial arms radially and outwardly extended from said outer wall of said hollow shaft to said inner wall of said rotatable slot to coaxially support said hollow shaft within said rotatable slot.

7. The work light, as recited in claim 6, wherein said communication cable is extended between two adjacent radial arms to extend through said rotatable slot.

8. The work light, as recited in claim 7, wherein said joint assembly further comprises a shaft locker detachably coupled at a bottom end of said coupling shaft to lock up said top casing at said base casing.

9. The work light, as recited in claim 7, wherein said top casing comprises a ceiling cover alignedly covering said rotatable slot when said top casing is coupled at said base casing, wherein said ceiling cover has a center through hole for said coupling shaft extending therethrough.

10. The work light, as recited in claim 9, wherein said top casing further has a communication slot formed at said ceiling cover for said communication cable extending from said control panel to said rotatable slot through said communication slot.

11. The work light, as recited in claim 1, further comprising a control panel provided at said top casing and electrically connected to said light source assembly via a communication cable, wherein said communication cable is extended from said top casing to said base casing through said rotatable slot to electrically connect said control panel to said light source assembly.

12. The work light, as recited in claim 1, wherein said joint assembly further comprises a shaft locker detachably coupled at a bottom end of said coupling shaft to lock up said top casing at said base casing.

13. The work light, as recited in claim 1, wherein said top casing comprises a ceiling cover alignedly covering said rotatable slot when said top casing is coupled at said base casing, wherein said top casing further has a shaft through hole aligned at a center of said ceiling cover for said coupling shaft extending therethrough.

14. The work light, as recited in claim 1, wherein said top casing comprises a downward protruding member downwardly extended from a bottom side of said top casing, wherein said base casing comprises a raised protruding member upwardly extended from a top side of said base casing to bias against said downward protruding member, wherein a total height of said downward protruding member and said raised protruding member matches with a thickness of said swing arm, such that when said top casing is coupled on said base casing, said swing arm is rotatably coupled between said bottom side of said top casing and said top side of said base casing.

15. The work light, as recited in claim 1, further comprising a battery assembly coupled at said base casing to electrically connect with said light source assembly, wherein said battery assembly comprises an outer protective casing, and a battery pack received in said outer protective casing for receiving one or more batteries in a battery cavity of said battery pack.

16. The work light, as recited in claim 15, wherein said battery pack has an engaging groove formed around said battery cavity, wherein said outer protective casing comprises an engaging ridge extended from an inner side of said outer protective casing to engage with said engaging grove to shield said battery cavity.

17. The work light, as recited in claim 16, wherein said base casing has a battery compartment, wherein said battery assembly further comprises a locking member movably extended out of said outer protective casing to lock up with said base casing so as to secure said battery assembly at said base casing.

18. The work light, as recited in claim 17, wherein said locking member has a locking hook extended from said battery pack out of said outer protective casing through a window thereof, such that said locking member is moved between a locked position that said locking hook is moved out of said window to engage with said base casing and an unlocked position that said locking hook is moved within said window to disengage with said base casing.

19. The work light, as recited in claim 18, wherein said battery assembly further comprises a resilient element extended from said battery pack to push said locking hook out of said through window of said outer protective casing to lock up with said base casing.

20. The work light, as recited in claim 19, wherein said outer protective casing has one or more water drainage slots for draining water in case of the water enters into said outer protective casing.

21. The work light, as recited in claim 15, wherein said base casing has a battery compartment, wherein said battery assembly further comprises a locking member movably extended out of said outer protective casing to lock up with said base casing so as to secure said battery assembly at said base casing.

22. The work light, as recited in claim 21, wherein said locking member has a locking hook extended from said battery pack out of said outer protective casing through a window thereof, such that said locking member is moved between a locked position that said locking hook is moved out of said window to engage with said base casing and an unlocked position that said locking hook is moved within said window to disengage with said base casing.

23. The work light, as recited in claim 22, wherein said battery assembly further comprises a resilient element extended from said battery pack to push said locking hook out of said through window of said outer protective casing to lock up with said base casing.

24. The work light, as recited in claim 15, wherein said outer protective casing has one or more water drainage slots for draining water in case of the water enters into said outer protective casing.

25. The work light, as recited in claim 1, wherein said light casing further comprises a light stand which comprises two upward extending arms rotatably coupled at two sides of said base casing respectively.

* * * * *